United States Patent [19]

Molnar et al.

[11] Patent Number: 4,963,392

[45] Date of Patent: Oct. 16, 1990

[54] FIBER SPRAY SYSTEM

[75] Inventors: Julius J. Molnar, Amherst; Richard A. Becker, Lorain, both of Ohio

[73] Assignee: Nordson Corporation, Westlake, Ohio

[21] Appl. No.: 261,036

[22] Filed: Oct. 21, 1988

[51] Int. Cl.[5] ..... B05C 5/00

[52] U.S. Cl. ..... 427/180; 118/308; 118/324; 222/630; 222/637; 239/325; 239/345; 239/346; 406/73; 406/121; 427/206; 427/421

[58] Field of Search ..... 118/308, 314, 322, 324; 156/279; 405/80.1, 81.1, 82.1, 83.1; 19/296; 239/375, 345, 346; 222/630 X, 637 X; 406/73, 108, 121 X, 134, 144; 427/180, 206, 421

[56] References Cited

U.S. PATENT DOCUMENTS

| | | | |
|---|---|---|---|
| 3,746,54 | 7/1973 | Duncan et al. | 406/144 |
| 4,129,38 | 12/1978 | Mudgett | 406/135 |
| 2,026,732 | 1/1936 | Farley | 406/65 |
| 2,091,055 | 8/1937 | Roselund et al. | 118/308 |
| 2,150,275 | 1/1938 | Thompson | 118/308 |
| 2,173,032 | 9/1939 | Wintermute | 427/26 |
| 2,193,849 | 3/1940 | Whitfield | 241/32 |
| 2,221,338 | 11/1940 | Wintermute | 424/40 |
| 2,550,354 | 4/1951 | Jacobsen | 406/65 |
| 2,614,528 | 10/1952 | Britcher | 118/308 |
| 2,675,147 | 4/1954 | Odom | 118/308 |
| 2,675,330 | 4/1954 | Schwartz et al. | 118/308 |
| 2,861,548 | 11/1958 | Burgess, Jr. et al. | 91/227 |
| 2,889,083 | 6/1959 | Schwinhorst | 128/201.15 |
| 2,941,841 | 6/1960 | Davis | 406/135 |
| 2,964,244 | 12/1960 | Pennington | 406/71 |
| 2,985,279 | 5/1961 | Burgess, Jr. | 198/768 |
| 3,021,079 | 2/1962 | Sovia et al. | 118/308 |
| 3,023,738 | 3/1962 | Burgess, Jr. | 91/234 |
| 3,280,964 | 10/1966 | Burgess, Jr. | 198/957 |
| 3,288,537 | 11/1966 | Hitch | 406/144 |
| 3,314,732 | 4/1967 | Hagan | 406/34 |
| 3,347,469 | 10/1967 | Ross et al. | 239/424 |
| 3,367,480 | 2/1968 | Burgess, Jr. | 131/207 |
| 3,436,442 | 4/1969 | Saks | 264/24 |
| 3,444,999 | 5/1969 | Hurst | 118/308 |
| 3,504,861 | 4/1970 | Peeps et al. | 239/300 |
| 3,529,870 | 9/1970 | Woten | 406/53 |
| 3,551,178 | 12/1970 | Chmelar | 427/27 |
| 3,740,260 | 6/1973 | Winn, Jr. | 428/328 |
| 3,861,599 | 1/1975 | Waggoner | 239/654 |
| 3,889,636 | 6/1975 | Smith | 118/621 |
| 3,907,170 | 9/1975 | Schedrin et al. | 406/47 |
| 3,995,775 | 12/1976 | Birkmeier et al. | 406/96 |
| 4,092,737 | 5/1978 | Sandell | 366/3 |
| 4,109,861 | 8/1978 | McHugh | 239/707 |
| 4,236,654 | 12/1980 | Mello | 222/238 |
| 4,246,294 | 1/1981 | Jordan | 427/27 |
| 4,311,113 | 1/1982 | Jordan | 118/629 |
| 4,560,307 | 12/1985 | Deitesfeld | 406/63 |
| 4,600,603 | 7/1986 | Mulder | 427/180 |
| 4,710,067 | 12/1987 | Salley | 406/64 |

FOREIGN PATENT DOCUMENTS

| | | |
|---|---|---|
| 2014477 | 8/1979 | United Kingdom . |

*Primary Examiner*—Willard Hoag

*Attorney, Agent, or Firm*—Wood, Herron & Evans

[57] ABSTRACT

A fiber spray system for depositing fibers onto a substrate or article comprises a vibrating feeder bowl having an opening in its sidewall covered by a grid or screen through which fibers loaded into the feeder bowl are discharged therefrom into the fiber collector. A delivery hose is connected between the fiber collector and a pump which is operative to create a negative pressure within the fiber collector to draw fibers through the grid of the feeder bowl, out of the feeder bowl into the fiber collector and to entrain the collected fibers within a stream of air. The air-entrained fibers are drawn through the delivery hose to the pump, and in the course of passage therethrough the velocity of the fibers is reduced so that they collect or accumulate within an area in the delivery hose upstream from the pump. The pump uniformly withdraws fibers from the area where they accumulate and discharges the fibers directly into a spray gun connected to the pump for deposition onto a substrate.

32 Claims, 4 Drawing Sheets

FIBER SPRAY SYSTEM

FIELD OF THE INVENTION

This invention relates to apparatus for spraying fibers, and, more particularly, to an apparatus for spraying fibers topically onto a surface or within the interior of a substrate.

BACKGROUND OF THE INVENTION

In certain applications, it is desirable to deposit flock or fiber material topically onto the surface of a substrate to form a coating. Alternatively, fibers are injected into the substrate to form a layer therein or a blend with one or more other materials forming the substrate. The fiber material employed can be synthetic or organic and vary in size from a few thousandths of an inch to one inch or longer. In some applications, an electrostatic charge is imparted to the fiber material so that it is attracted and adheres to a target object or surface held at ground or a different electrical potential. Alternatively, the fiber material is ejected onto a surface coated with an adhesive material so that the fibers adhere thereto.

Prior art systems for spraying fiber material onto a substrate or object generally comprise a hopper in which the fibers are loaded in bulk quantities, a chamber wherein fibers discharged from the hopper are entrained in a stream of air and a spray device communicating with the chamber for ejecting the air-entrained fiber material onto a substrate or other object. Systems of the type described above have a variety of mechanical elements for handling and transmitting the fibers which are designed to obtain a relatively uninterrupted and steady flow of fibers throughout the system so that a uniform pattern of fibers is discharged from the spray gun.

For example, hoppers in the fiber spray systems mentioned above are formed with an opening through which fibers are dispensed into an air entrainment chamber and such openings are often provided with a perforated grid or other closure mechanism to control the flow rate of fibers therethrough. Additionally, various devices have been provided for mechanically directing the particles through the opening in the hopper such as rotating paddles as shown in U.S. Pat. Nos. 4,560,307 to Deitesfeld; 3,347,469 to Ross et al; and, 3,551,178 to Chmelar; screw feeders as shown in U.S. Pat. Nos. 3,907,170 to Schedrin et al; and, 2,889,083 to Schwinhorst; and, rotating brushes such as disclosed in U.S. Pat. No. 4,311,113 to Jordan. Each of these mechanisms are carried within the interior of the hopper and function to push or force fiber material through an opening in the hopper and into a chamber for entrainment in a stream of air.

Regardless of the construction of the hopper and/or fiber feeding devices, it is desirable to not only provide for a uniform flow or discharge of fibers from the hopper, but to also permit adjustment of the feed rate of fibers therefrom. Additionally, fiber spray systems are preferably adapted to handle fibers of different size and/or density to accommodate different spraying applications. Each of the systems described in the patents listed above have one or more operating deficiencies which limits the capability of such systems to adapt to different types of applications and/or to certain kinds of fibers and not others.

Another important aspect of fiber spraying systems is to ensure that the air-entrained fibers are transmitted through the system and discharged from the spray gun without the fibers clumping or bunching together. In most systems, the fibers are discharged from the feed hopper into a chamber or tube connected to a pump which entrains the fibers in a stream of air and then forces the air-entrained fibers through a hose connected to a spray device located remotely from the pump. Although many systems are effective in entraining the fiber material in a stream of air, a relatively long flow path is often provided between the pump and the spray device along which the fibers can clog or bunch together. This can produce a pulsating or uneven discharge of fibers from the spray device which is unacceptable in many spraying applications.

SUMMARY OF THE INVENTION

It is therefore among the objectives of this invention to provide a fiber spray system which produces a uniform, repeatable fiber pattern upon a substrate or other object to be sprayed, which is adaptable to fibers of different size and/or density, and which is capable of varying the flow rate of fibers discharged onto a surface.

These objectives are accomplished in a fiber spray system which includes a vibrating feeder bowl having an opening in its sidewall covered by an apertured grid or screen through which fibers are discharged from the feeder bowl into a fiber collector where they are entrained in a stream of air. A delivery hose is connected between the outlet of the fiber collector and the suction inlet of a pump. The velocity of the air-entrained fibers through the delivery hose is controlled so that the fibers accumulate within the hose at a predetermined location or area from its outlet end. The pump uniformly withdraws the fibers from the delivery hose at such location and then discharges them directly into a spray gun mounted thereto for deposition onto a substrate or other target object.

One aspect of this invention is predicated upon obtaining a uniform and controlled discharge of fibers from the feeder bowl into the fiber collector within which the fibers are entrained in a stream of air. In this connection, the rate of discharge of fibers from the feeder bowl is variable, and fibers of different size and density can be accommodated.

In the presently preferred embodiment, a vibrating feed hopper and a vibrating trough receive fiber material in bulk and smoothly transmit such fibers into the interior of the feeder bowl. The feeder bowl is formed with a spiral feed track along the interior surface of its sidewall which extends radially inwardly from the sidewall toward the center of the bowl. An opening is formed in the feed track at a point intermediate the bottom surface and top lip of the feeder bowl which is covered by an apertured grid or screen removably affixed to the sidewall of the feeder bowl. The vibrating feeder bowl is effective to move fibers deposited therein in a spiral path along its feed track and such fibers are made to pass across the grid or screen mounted over the opening in the feed track before they reach the top of the feeder bowl.

The fiber collector is mounted to the sidewall of the feeder bowl directly beneath the opening therein so that fibers passing through the screen fall into the interior of the fiber collector. The fiber collector is formed with an inlet open to atmosphere and an outlet connected by a delivery hose to a pump. The pump is operative to create a negative pressure within the delivery hose and fiber collector to draw fibers from the feeder bowl into the interior of the fiber collector, and to draw ambient air into the fiber collector through its inlet for entrainment of the fibers therein.

The flow rate of fibers from the feeder bowl into the fiber collector is controlled by the configuration of the apertured grid or screen, and also by the level of the negative pressure applied within the interior of the fiber collector. The quantity of fibers withdrawn from the feeder bowl is determined, in part, by the size of the apertures or holes in the screen covering the opening in the sidewall of the feeder bowl and also by the width and length of the opening formed in the feed track of the feeder bowl. The size of the holes in the grid or screen is chosen to permit fibers of a given size to pass therethrough without regard to orientation of the fibers in any particular direction. The screen is mounted to the feed track of the feeder bowl so that it can be easily removed and replaced with another screen having different aperture size to accommodate fibers of different length and/or thickness.

The rate of passage of fibers through the screen in the feeder bowl is also controlled by the level of the negative pressure applied by the pump within the interior of the fiber collector. Slidable plates are incorporated in one wall of the fiber collector which open or close an opening to the interior of the fiber collector so that more or less ambient air can pass therethrough. For example, as the flow of ambient air into the interior of the fiber collector decreases, i.e., by closing the slidable plates, the level of the negative pressure applied by the pump to the interior of the fiber collector increases. In turn, a greater quantity of fibers are withdrawn from the feeder bowl into the interior of the fiber collector.

Another aspect of this invention involves the passage of the air-entrained fibers from the fiber collector to the spray gun so that the fibers are discharged from the spray gun at a uniform, uninterrupted rate. An important advantage of this invention is that uneven or pulsating fiber flow is essentially eliminated so that a uniform, repeatable pattern of fibers is discharged from the spray gun onto a substrate or other target object.

In the presently preferred embodiment, the delivery tube has an inlet end connected to the outlet of the fiber collector and an outlet end connected to the suction inlet of the pump. The pump is mounted directly to the spray gun to eliminate any tubing or other extended flow paths between the outlet of the pump and spray gun. Preferably, the outlet end of the delivery hose is positioned vertically higher than its inlet end so that the air-entrained fiber stream flows vertically upwardly in the course of passage through the delivery hose from the fiber collector to the pump. Additionally, an air amplifier is located upstream from the suction inlet of the pump which directs a constant volume of air into the delivery hose and pump.

It has been found that the pump must be operated at a predetermined pressure to ensure fibers of a given size and density are discharged from the pump into the spray gun, and then subsequently ejected from the spray gun, with sufficient velocity to cover an object to be sprayed or to inject fibers into a substrate. At such operating pressure, the negative pressure created by the pump within the interior of the delivery hose can draw the fibers therethrough at a relatively high velocity. It has been found that a relatively high velocity flow of fibers through the delivery hose can result in an uneven or pulsed supply of fibers to the spray gun.

The problem of uneven or pulsed fiber flow is avoided in this invention by the elevated position of the outlet end of the delivery hose, and the volume of air introduced upstream from the pump by the air amplifier, which have the combined effect of creating a collection or accumulation of fibers at a predetermined location or area along the delivery hose upstream with respect to the suction inlet of the pump. The accumulation of fibers within the delivery hose takes place because the volume of air injected into the delivery hose by the air amplifier reduces the negative pressure created by the pump within the delivery hose thus reducing the velocity of the fibers therein; and, as the fibers travel vertically upwardly from the lower, inlet end to the higher, outlet end of the delivery hose, they tend to collect or accumulate therein at an area upstream from the pump.

The pump then draws fibers from this reservoir or accumulation within the delivery hose producing a uniform, uninterrupted flow of fibers to the spray gun. In the presently preferred embodiment, the spray gun is mounted directly to the outlet of the pump which eliminates any tubing or hoses therebetween. The fibers are discharged from the pump directly into the spray gun to eliminate any clogs or bunching up of the fibers prior to discharge from the spray gun. Preferably, the substrate or articles to be sprayed with fibers are carried on a conveyor movable beneath the spray gun within a spraying compartment of the fiber spray system so that over-sprayed fibers can be collected and returned to the feed hopper.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
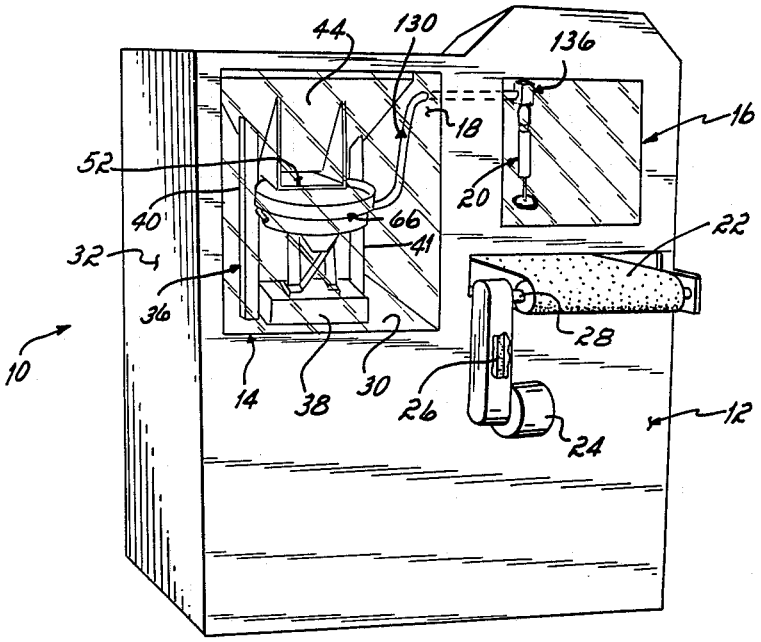
FIG. 1 is a schematic perspective view of the fiber spray system of this invention.
Figure 2:
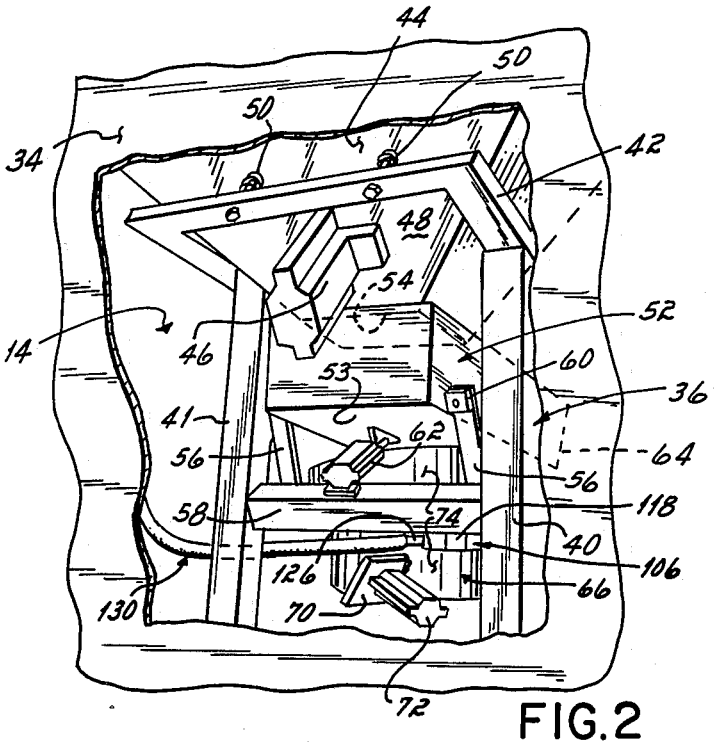
FIG. 2 is a fragmentary back view of the system of FIG. 1 in which a portion of the back wall is cut away to illustrate the vibratory devices for the feed hopper, trough and feeder bowl.

Referring now to FIGS. 1 and 2, the fiber spray system 10 of this invention comprises a cabinet 12 having a fiber delivery compartment 14 and a fiber spray compartment 16 divided by a common wall 18. Fiber material is deposited in bulk into the fiber delivery compartment 14, entrained in a stream of air and then delivered to the fiber spray compartment 16 for discharge through a spray gun 20 mounted therein. As described below, in one preferred application, the spray gun 20 ejects the fibers onto articles coated with adhesive (not shown) which are transferred through the fiber spray compartment 16 atop a conveyor 22 driven by a motor 24 connected by a belt 26 to a conveyor drive rod 28.

As used herein, the term "fiber" refers to a synthetic or organic strand of material. In one application of this invention, as discussed below, the fiber spray system 10 is operable to spray nylon fibers having a length of about 0.040 to 0.125 inches and a thickness of about 3 to 9 denure.

Fiber Delivery Structure

Figure 3:
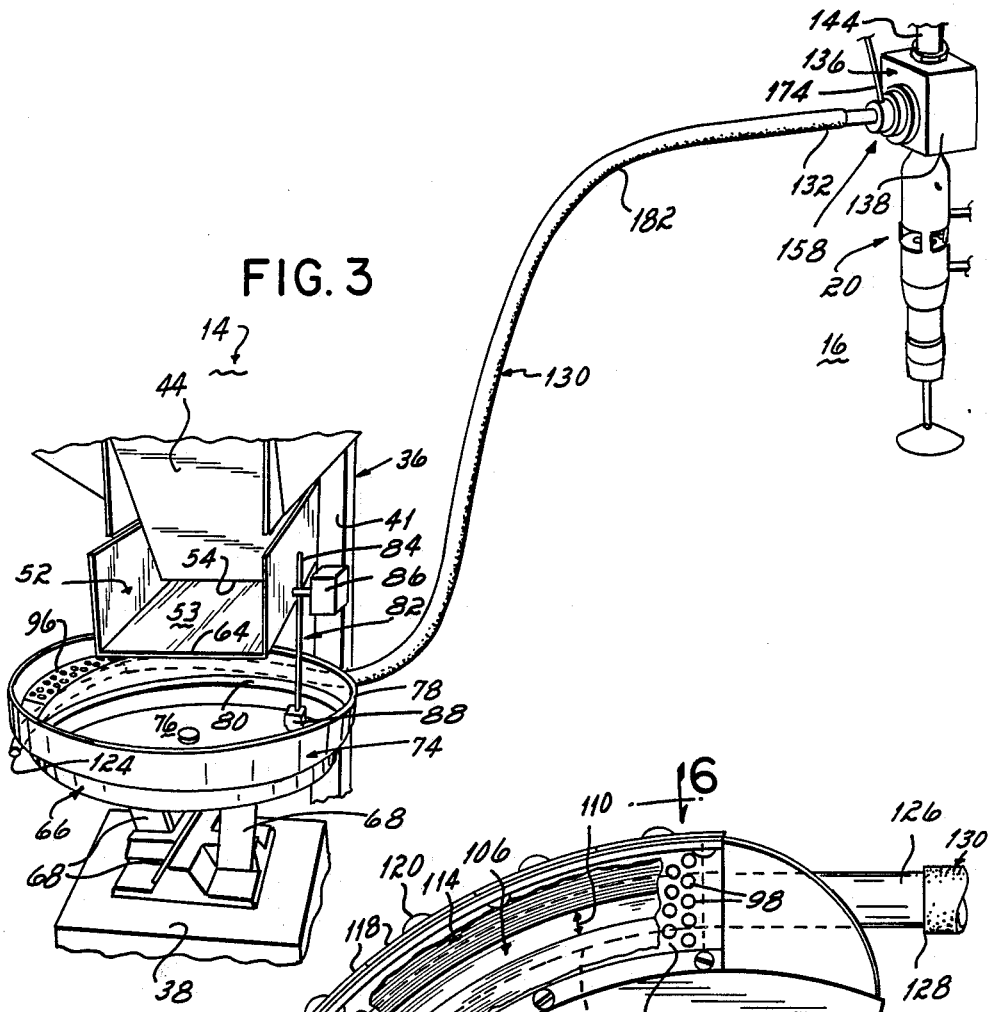
FIG. 3 is a schematic, perspective view of the feed hopper, trough and feeder bowl connected to the inlet end of a delivery hose and a pump and spray gun connected to the outlet end of the delivery hose.

Referring now to FIGS. 1-3, the elements which deliver the fibers to the spray gun 20 are schematically illustrated. The fiber delivery compartment 14 is defined by the common wall 18, a floor 30, sidewall 32 and a rear wall 34. A frame 36 is located within the fiber delivery compartment 14 having a base 38 resting atop the floor 30 and upright arms 40, 41 extending upwardly from the base 38.

A mounting bracket 42 carried atop the upright arms 40, 41 supports a feed hopper 44 which is open at the top of the fiber delivery compartment 14 to receive fibers thereat. A pneumatic vibration device 46 is mounted to a back wall 48 of the feed hopper 44 and compression springs 50 extend between the mounting bracket 42 and back wall 48. The pneumatic vibration device 46 and compression springs 50 are effective to vibrate the feed hopper 44 so that fibers deposited therein are uniformly discharged into a trough 52 mounted beneath an opening 54 formed in the base of the feed hopper 44. This trough 52 is carried by leaf springs 56 which extend between a cross piece 58 carried by the frame arms 40, 41 and extensions 60 mounted on either side of the trough 52. A pneumatic vibration device 62 is mounted to the bottom wall 53 of trough 52 which, together with the leaf springs 56, is effective to vibrate the trough 52 to transmit fibers received from the feed hopper 44 therealong.

As best shown in FIGS. 1 and 3, the trough 52 is formed with a discharge end 64 which is positioned over the open top of a feeder bowl 66. The feeder bowl 66 is carried by four leaf springs 68 connected between the base 38 of frame 36 and the bottom of the feeder bowl 66. An extension 70 is mounted at an angle to the base to the feeder bowl 66 and supports a pneumatic vibration device 72. The pneumatic vibration device 72 and four leaf springs 68 are effective to vibrate the feeder bowl 66 so that fibers deposited therein travel along the annular sidewall 74 of the feeder bowl 66 from its bottom surface 76 toward the top lip 78. The fibers are made to move in a spiral path along the sidewall 74 of the feeder bowl 66 by a feed track 80 which extends radially inwardly from the sidewall 74 and is oriented in a spiral from the bottom surface 76 to the top lip 78 of feeder bowl 66.

Preferably, a level indicator 82 is provided which comprises a trigger rod 84 carried by a limit switch 86 and a cup-shaped float 88 secured to one end of the mounting rod 84 within the interior of the feeder bowl 66. When the fibers deposited into the feeder bowl 66 reach a predetermined level, the trigger rod 84 is moved to activate the limit switch 86 which shuts off the pneumatic vibration devices 46 and 62 for the feed hopper 44 and trough 52, respectively. This stops the flow of fibers into the feeder bowl 66.

The above-described structural elements of the fiber delivery portion of this invention are commercially available items which have been used in the past to handle such items as nuts, bolts and particulate material but not fibers, and their structural details described briefly above form no part of this invention per se. The vibrating feed hopper 44 is commercially available from Burgess and Associates, Inc. of Avon Lake, Ohio and is identified as a "Vibron Pneumatic Powered Movable Wall Supply Hopper", Model VP-20. A vibrator employed in this type of feed hopper is disclosed, for example, in U.S. Pat. No. 2,861,548. The same company also manufactures the vibrating feeder bowl 66 which is identified as a "Vibron Pneumatic Resonance Balanced Parts Feeder", Model 18AAH. Vibrating feeder bowls 66 having a spiral feed track of the type sold by Burgess and Associates, Inc. are disclosed, for example, in U.S. Pat. Nos. 3,023,738; 3,280,964; and, 3,367,480. The limit switch 86 is preferably one manufactured by Namco Controls of Mentor, Ohio under Part No. EA15030014. It is contemplated that any other equivalent elements could be substituted for these parts without departing from the scope of this invention.

Figure 4:
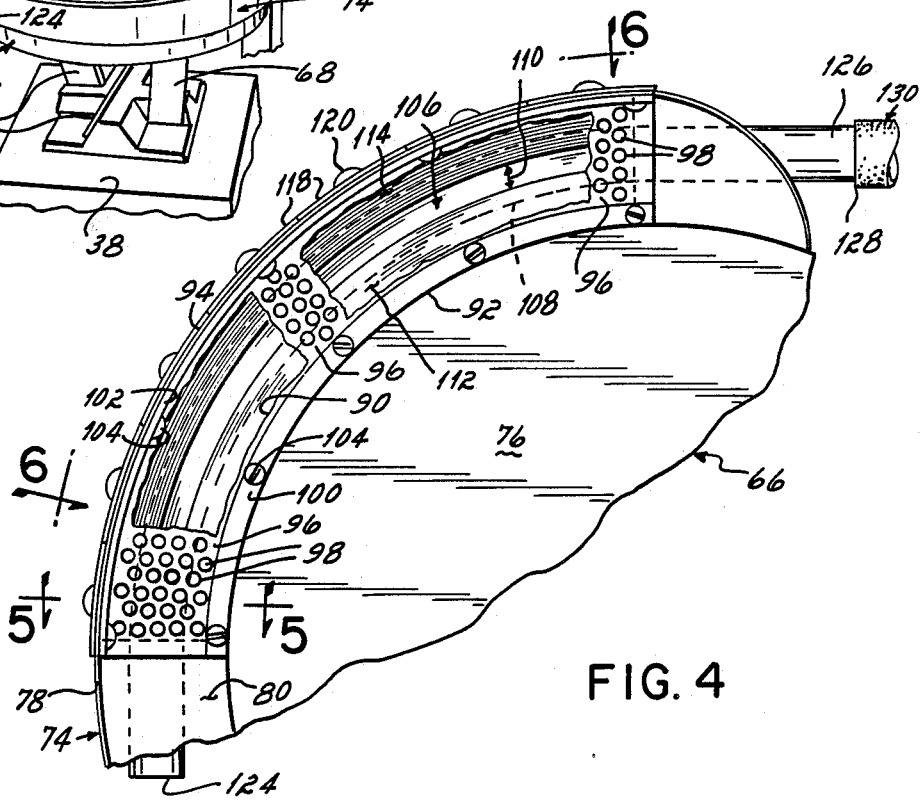
FIG. 4 is an enlarged plan view of a portion of the feeder bowl where fibers are removed therefrom.
Figure 5:
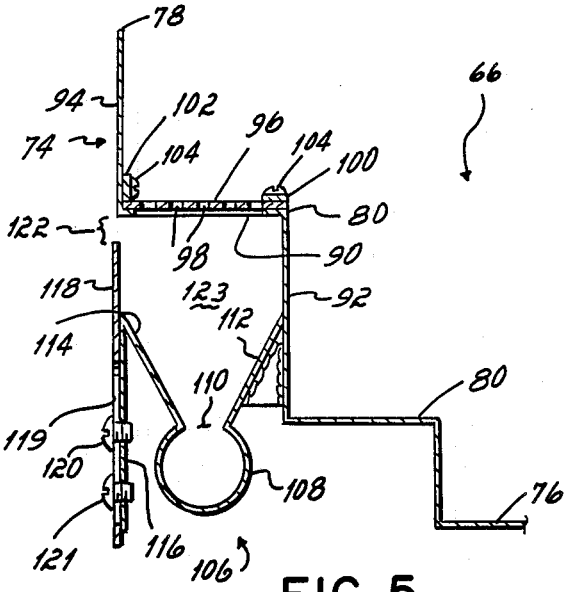
FIG. 5 is a cross sectional view taken generally along lines 5—5 of FIG. 4 showing the fiber collector herein.

Referring now to FIGS. 3-5, illustrations are provided of modifications to the commercially available feeder bowl 66, and additional structure is shown in which fibers transferred from the feeder bowl 66 are entrained in a stream of air.

In the presently preferred embodiment, an opening 90 is formed in the feed track 80 of feeder bowl 66 at a point intermediate the bottom surface 76 and top lip 78 thereof. At this location along sidewall 74 of feeder bowl 66, the feed track 80 extends substantially horizontally between an inner section 92 of the sidewall 74 and an outer section 94 thereof.

As best shown in FIG. 4, the opening 90 in feed track 80 is covered by an apertured grid or screen 96 having a plurality of regularly spaced openings 98. One side of the screen 96 is secured to the feed track 80 by a first plate 100 affixed atop the feed track 80, and a second plate 102 is mounted vertically on end atop the opposite, outer side of screen 96 and against the outer section 94 of the feeder bowl sidewall 74. Both the first and second plates 100, 102 are secured in place to the feeder bowl 66 by screws 104 or similar fasteners.

As the fibers move along the sidewall 74 of the vibrating feeder bowl 66, they travel along the feed track 80 and pass over the opening 90 therein covered by screen 96. A portion of the fibers fall by gravity and/or are drawn through the screen 96, as described in more detail below, and are directed into a fiber collector 106 which is positioned beneath the opening 90 and screen 96. The remainder of the fibers fall back into the feeder bowl 66.

Figure 6:
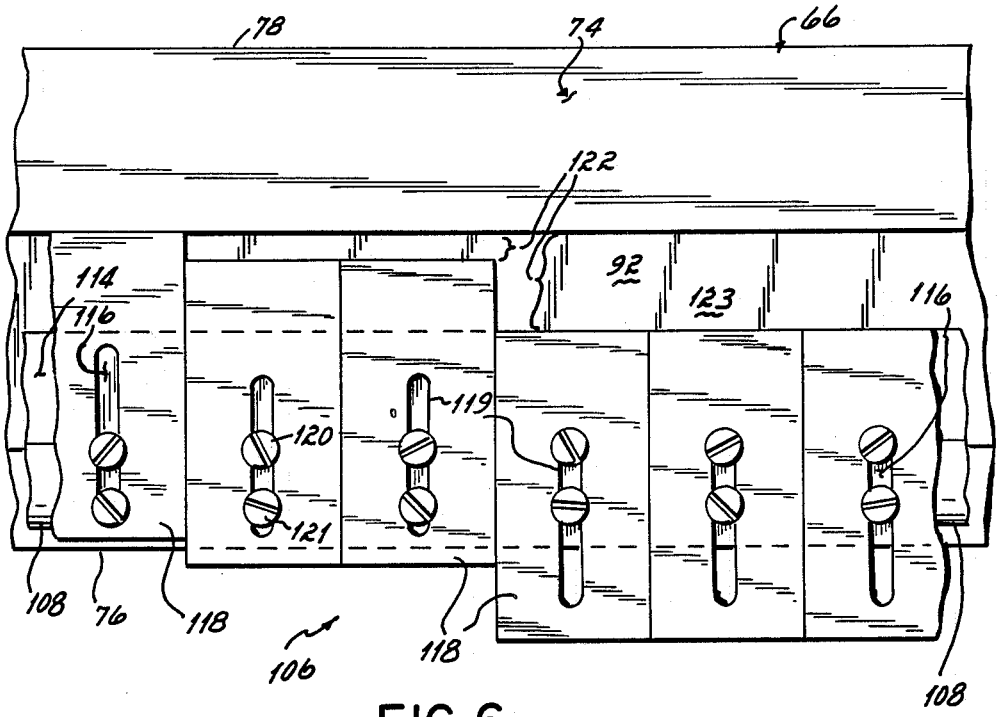
FIG. 6 is a partial, elevational view of the negative pressure adjustment plates for the fiber collector taken generally along lines 6—6 of FIG. 4.

As shown in FIGS. 4-6, the fiber collector 106 comprises an elongated, arcuate-shaped tube 108 which extends around a portion of the feeder bowl 66 beneath the opening 90 in its sidewall 74. The tube 108 is formed with a pair of tapered fiber guides 112, 114 which extend upwardly and outwardly on either side of a slot 110 formed at the top of the tube 108. The fiber guide 112 is fixedly connected to the outside of the feeder bowl inner sidewall 92 to mount the fiber collector 106 beneath the opening 90. The other fiber guide 114 mounts a vertical plate 116 which supports a number of slide plates 118. The fiber collector 106 therefore has an interior 123 having sides defined by the inner sidewall 92 and slide plates 118, a top formed by the screen 96 and a bottom formed by the tube 108.

The slide plates 118 are each formed with a vertical slot 119 which receive a pair of screws 120, 121 threaded into the vertical plate 116. By loosening the screws 120, 121, the slide plates 118 are each slidable along slots 119 between a lowered position wherein the top of a slide plate 118 is located adjacent the top of fiber guide 114, and a raised position in which the top of a slide plate 118 is located at or near the outer section 94 of the feeder bowl sidewall 74. The slide plates 118 therefore open or close a path or opening 122 into the interior 123 of the fiber collector 106 for purposes to become apparent below.

As shown in FIGS. 3 and 4, the slotted tube 108 is formed with an inlet 124 open to atmosphere and an outlet 126 which is connected to the inlet 128 of a delivery hose 130. The delivery hose 130 extends from the fiber collector 106 vertically upwardly through the common wall 18 separating compartments 14, 16, and then into the fiber spray compartment 16 where the outlet end 132 of delivery hose 130 is connected to the suction inlet 134 of a pump 136. The pump 136 is operative to assist in the controlled removal of fibers from the feeder bowl 66, and to entrain these fibers within a stream of air drawn into the fiber collector 106. This operation proceeds as follows.

In a manner described more fully below, the pump 136 is activated to create a negative pressure within the delivery hose 130. In turn, a negative pressure is created within the interior 123 of fiber collector 106 because of the connection between the slotted tube 108 and the delivery hose 130. The negative pressure within fiber collector 106 performs two functions. First, fibers are drawn downwardly through the screen 96 from the feeder bowl 66 and fall along the fiber guides 112, 114 through the slot 110 and into the interior of tube 108. Secondly, the negative pressure within tube 108 draws a stream of ambient air through its inlet end 124 within which the fibers are entrained. An air-entrained fiber stream is therefore formed within the tube 108 which is drawn to its outlet end 126 and discharged into the delivery hose 130.

The flow rate and/or quantity of fibers withdrawn from the feeder bowl 66 can be controlled in a variety of ways. Depending upon the size of the fibers employed in a given application, the length and width of the opening 90 in feed track 80 can be modified. Alternatively, the size and/or spacing of the openings 98 in screen 96 can be varied by replacing one screen 96 with another. These modifications allow more or less fibers to fall by gravity or through the feeder bowl 66, and/or be drawn therethrough by pump 136, as they move along feed track 80.

Assuming the pump 136 is operated at constant pressure, the level of negative pressure applied within the fiber collector 106 can be controlled by adjusting the position of one or more slide plates 118, which, in turn, control the flow rate of fibers drawn through screen 96. For example, if one or more slide plates 118 are placed in a lowered position, i.e., wherein their top ends are located adjacent the top of the fiber guides 112, 114, a relatively large opening 122 is provided to the interior 123 of the fiber collector 106 allowing more ambient air to pass therethrough. This reduces the suction or negative pressure within the interior 123 of the fiber collector 106 and thus reduces the flow rate of fibers drawn through screen 96 by the pump 136 in which case the fibers fall primarily by gravity into the fiber collector 106. On the other hand, if one or more slide plates 118 are moved to a raised position adjacent the outer section 94 of the feeder bowl sidewall 74, the size of the opening 122 is small allowing little or no ambient air to pass into the fiber collector 106 except through the inlet 124 of tube 108. As a result, the suction or negative pressure within the fiber collector 106 is increased which draws more fibers through the screen 96 into fiber collector 106.

Alternatively, the negative pressure within fiber collector 106 can be increased or decreased by maintaining the slide plates 118 in a fixed position and manipulating a valve (not shown) mounted to the inlet 124 of slotted tube 108. By allowing more or less ambient air to pass into the tube 108 through its inlet 124, the negative pressure within fiber collector 106 is varied as desired.

Fiber Discharge Structure

Figure 7:
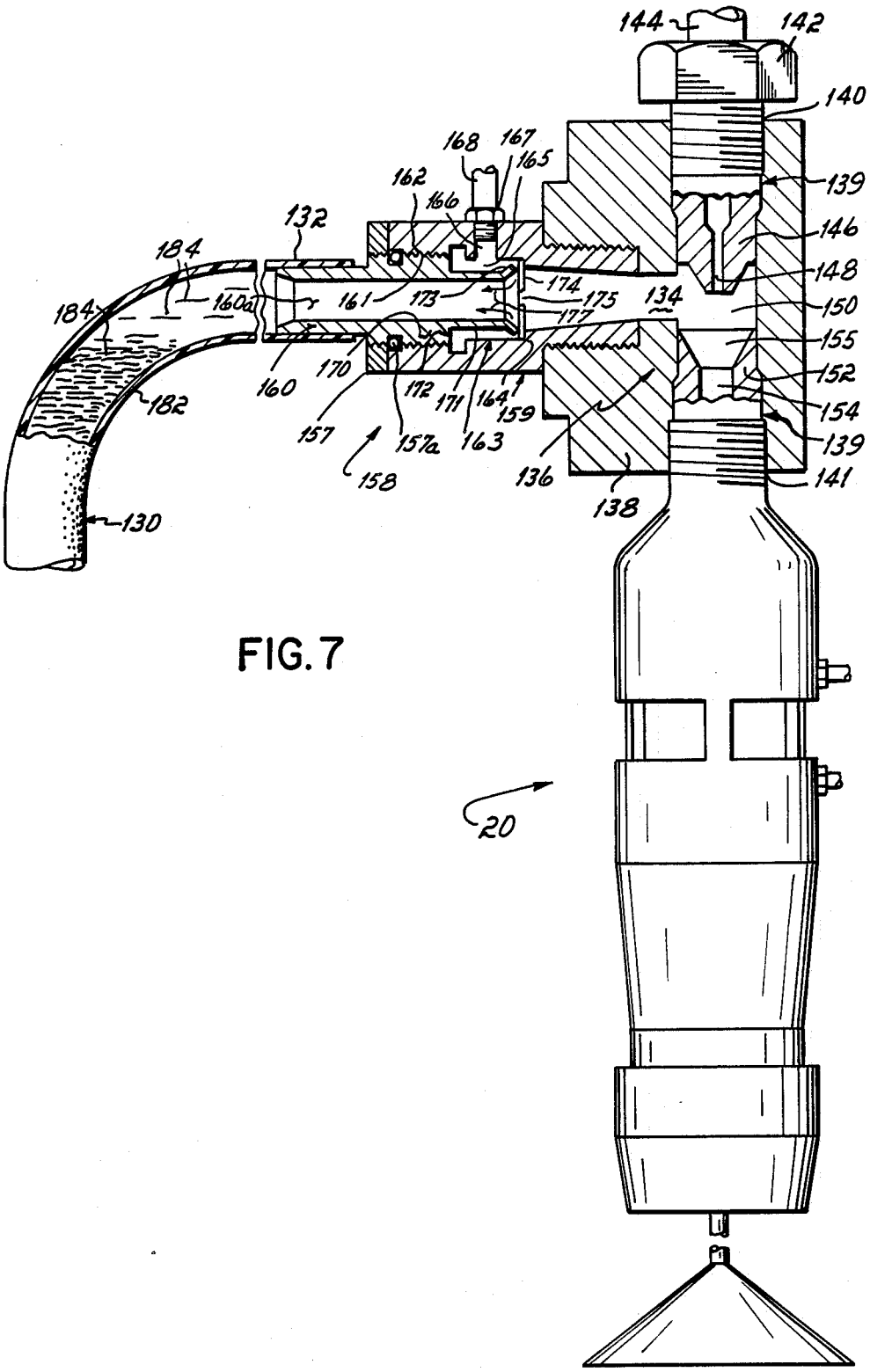
FIG. 7 is an enlarged view in partial cross section and partial elevation showing the outlet end of the delivery hose, pump and spray gun herein.

Referring now to FIGS. 3 and 7, structure is illustrated which forms the fiber discharge portion of the fiber spray system 10 located within the fiber spray compartment 16 of cabinet 12.

As described above, fibers are withdrawn from the feeder bowl 66 and entrained in a stream of air within the fiber collector 106. This air-entrained stream of fibers exits the fiber collector 106 and enters the inlet end 128 of the delivery hose 130. As shown in FIGS. 1 and 3, the inlet end 128 of the delivery hose 130 is located at the level of the feeder bowl 66 within the fiber delivery compartment 14. The delivery hose 130 extends vertically upwardly from the feeder bowl 66 through an opening (not shown) in the common wall 18 of cabinet 12, and then mounts to the pump 136 where its outlet end 132 communicates with the suction inlet 134 of pump 136. The vertical run of the delivery hose 130, i.e., the vertical height differential between its inlet end 128 and outlet end 132, is approximately 18 to 24 inches in the illustrated embodiment of this invention.

As shown in FIG. 7, the pump 136 comprises a pump body 138 formed with a throughbore 139 having an inlet 140 and an outlet 141. The inlet 140 of throughbore 139 receives a fitting 142 which is connected to an air inlet line 144 carrying compressed air. The throughbore 139 mounts a nozzle 146 having an axial passageway 148 which terminates at a region 150 formed by the intersection of the throughbore 139 and the suction inlet passageway 134 formed in pump body 138. An outlet tube 152 is mounted in the bore 139 opposite the nozzle 146 which is formed with a bore 154 having a tapered inlet or throat portion 155 at the boundary of region 150. The pump body 138 is formed with internal threads at the outlet 141 of passageway 139 downstream from outlet tube 152 which mount the gun body of the spray gun 20.

The pump 136 operates as follows. Pressurized air is injected into the throughbore 139 from delivery line 144 and enters the smaller diameter axial passageway 148 of nozzle 146 where it is accelerated. The accelerated stream of air passes through the region 150 and into the throat 155 of outlet tube 152. In the course of moving through region 150 and past the suction inlet passageway 134, a negative pressure is created within the suction inlet passageway 134 which draws air and/or fibers into the region 150 and then through the outlet tube 152. The air stream from nozzle 146 continues moving through the outlet tube 152 and forces air and/or fibers drawn therein directly into the spray gun 20 which mounts to the pump body 138.

In the presently preferred embodiment, the spray gun 20 is of the type disclosed in U.S. Pat. No. 4,600,603, assigned to the same assignee as this invention, the disclosure of which is incorporated by reference in its entirety herein. It is contemplated, however, that other types of spray guns could be utilized herein provided they can be adapted to mount to pump 134. Alternatively, a spray nozzle can be mounted directly to the outlet 141 of throughbore 139 to spray directly from the pump 136, thus eliminating a separate spray gun 20.

In the presently preferred embodiment, an air amplifier 158 is provided which is of the type described in U.S. patent application Ser. No. 097,946 to Schneider et al, filed Sept. 17, 1987, and entitled "Powder Spray Gun", the disclosure of which is incorporated by reference in its entirety herein.

The air amplifier 158 comprises a body 159 and a nozzle 160 having an axial bore **160*a*. The nozzle 160 and body 159 are both generally tubular in configuration and are retained in an assembled relationship with the nozzle 160 contained internally of the body 159 by a threaded connection. This threaded connection comprises external threads 161 on the periphery of the nozzle 160 and internal threads 162 on the interior of the body 159. A nut 157 and O-ring 157*a* seal the threads 161, 162. Preferably, the body 159 is formed with external threads which mate with internal threads within the suction inlet passageway 134 to mount the air amplifier 158 to the pump 136. The delivery hose 130 fits over the exterior surface of the nozzle 160 of air amplifier 158**.

The body 159 has a stepped axial bore 163 extending therethrough. This bore 163 is of larger diameter at the left end and smaller diameter at the right end as viewed in FIG. 7. Between the two different diameter sections there is a shoulder 164. Additionally, there is an interior annular channel 165 around the bore 163 adjacent the intersection of the threaded and unthreaded sections of the large diameter portion of the bore. Between the annular channel 165 and the shoulder 164 there is a radial port 166 which is connected by a fitting 167 to a delivery line 168 carrying compressed air.

The nozzle 160 of the air amplifier 158 is provided with a peripheral flange 170 upon which the threads 161 are formed Adjacent this flange 170 there is a section of reduced diameter 171 separated from the threads 161, 162 by a shoulder 172. The reduced diameter section 171 terminates in an outwardly flared end 173 of the nozzle 160. This outwardly flared end 173 of the nozzle 160 abuts the shoulder 164 of the body 159.

As discussed in detail in Ser. No. 097,946, the shoulder 164 of the body 159 forms a seat for the flared end 173 of the nozzle 160. To facilitate air flow, as indicated by the arrow 177 over this seat, there are three recesses 174 machined from the shoulder 164. As a result of these recesses being machined or formed in shoulder 164, the shoulder 164 comprises three raised sections or ribs 175 against which the lower end 173 of the nozzle 160 abuts, with the recesses 174 being located between the ribs 175.

In operation, compressed air from delivery line 167 enters amplifier 158 through port 166 and travels first along the annular channel 165 and then through the recesses 174 in the shoulder 164 of the body 159 against which the lower end 173 of nozzle 160 abuts. The compressed air turns in the opposite direction of shoulder 164 and flows in the direction indicated by arrows 177 within the axial bore **160*a* of nozzle 160. This flow of air through bore 160*a* is relatively even and well distributed along the cross section of bore 160*a* and flows smoothly in a direction upstream or away from the suction inlet passageway 134 of pump 136 toward the delivery hose 130**.

An important aspect of this invention is the combined effect of the orientation of the delivery hose 130, and the air flow through the air amplifier 158, on the flow of fibers through the delivery hose 130. Assuming the pump 136 is operated at constant pressure, the introduction of a volume of air through the air amplifier 158 upstream of the suction inlet 134 of pump 136 and downstream from the outlet of delivery hose 130 reduces the negative pressure applied by the pump 136 within the interior of delivery hose 130. In addition, the fibers are made to travel upwardly along a vertical path from the inlet end 128 of delivery hose 130 through a vertical distance of about 18 to 24 inches to a bend 182 in the delivery hose 130 where it passes through the common wall 18 of cabinet 12 between compartments 14, 16. This reduction in negative pressure within the delivery hose 130, coupled with the height differential between the inlet end 128 and outlet end 132 of delivery hose 130, decreases the velocity of the fibers in the area of the bend 182 in delivery hose 130. As a result, fibers 184 collect or accumulate in the area of the bend 182 upstream from the suction inlet passageway 134 of pump 136. The fibers 184 are then withdrawn or suctioned away from the area of the bend 182 by operation of the pump 136. The fibers enter the pump 136 through its suction inlet 134 and then are discharged through the outlet tube 152 directly into the spray gun 20 for spraying onto a substrate.

The accumulation of fibers 184 in the area of the bend 182 in the delivery hose 130 upstream from the pump 136 has the affect of eliminating or at least reducing pulsation or uneven delivery of fibers to the pump 136 and then into the spray gun 20. The fibers are effectively "picked off" or withdrawn at a uniform rate from the area of the bend 182 where they accumulate, and this essentially constant supply of fibers 184 at the bend 182 tends to reduce any surge or reduction of fiber flow which could produce an uneven spray pattern of fibers on a substrate.

In the presently preferred embodiment, the volume of air supplied by the air amplifier 158 can be adjusted by varying the air pressure in delivery line 168 so that the volume of air introduced upstream of the pump 136, and thus the level of negative pressure within the delivery hose 130, can be increased or decreased. By providing for variation in the negative pressure applied within delivery hose 130, the velocity of the fibers within delivery hose 130 can be increased or decreased as required This may be necessary in some applications to accommodate different types of fibers to be sprayed, to accommodate a height differential between the ends of the delivery hose 130 other than 18 to 24 inches depending upon the available space in a particular application, and/or to accommodate other variables in a spraying application In one application of the fiber spray system 10 of this invention, fibers 184 have been successfully sprayed in a uniform, repeatable pattern under the following parameters. Nylon fibers were employed having a length of 0.040 to 0.125 inches, and a thickness of 3 to 9 denure. The pressure of the air stream entering the pump 136 was set at 20 psi, and the pressure of the air stream entering the air amplifier 158 was set at 1 psi. The fibers 184 were discharged from a spray gun 20 of the type disclosed in U.S. Pat. No. 4,600,603.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, while the air amplifier 158 is shown in the Figs. in an orientation to direct a flow of air upstream with respect to the pump 136, it is contemplated that the air amplifier 158 could be oriented in the opposite direction to direct air downstream or toward the pump 136 and achieve the same result in lessening the velocity of fibers within delivery hose 130.

Therefore, it is intended that the invention not be limited to the particular embodiment disclosed as the best mode contemplated for carrying out this invention, but that the invention will include all embodiments falling within the scope of the appended claims.

I claim:

1. Apparatus for spraying fibers, comprising:

a fiber collector having an interior formed with an inlet and an outlet;

means for feeding fibers into said interior of said fiber collector;

a pump having a suction inlet and a discharge outlet;

a spray device connected to said discharge outlet of said pump;

a delivery hose having an inlet end connected to said outlet of said fiber collector and an outlet end connected to said suction inlet of said pump, said outlet end of said delivery hose being positioned vertically higher than said inlet end thereof, said pump creating a negative pressure within said interior of said fiber collector to entrain fibers therein within a stream of air drawn through said inlet of said fiber collector and to transmit said air-entrained fibers through said delivery hose from said fiber collector to said pump;

means for introducing a volume of air upstream from said suction inlet of said pump so that said air-entrained fibers accumulate in an area within said delivery hose upstream relative to said pump and said outlet end of said delivery hose, said pump being effective to withdraw said air-entrained fibers from said area within said delivery hose into said suction inlet thereof and to eject said air-entrained fibers through said discharge outlet into said spray device for deposition onto a substrate.

2. The apparatus of claim 1 in which said means for introducing a volume of air upstream from said suction inlet of said pump is an air flow amplifier which is oriented to direct a stream of air in an upstream direction within said delivery hose.

3. The apparatus of claim 1 in which said means for feeding fibers into said feeder chamber comprises:

a feed hopper having an inlet for receiving fibers in bulk and an outlet;

a trough connected to said outlet of said feed hopper, said trough having a discharge end;

means for vibrating said feed hopper and said trough to cause fibers to move through said outlet of said feed hopper onto said trough and then to said discharge end of said trough;

a feeder bowl located beneath said trough to receive fibers from said discharge end thereof, said feeder bowl having a bottom, a sidewall extending upwardly from said bottom and an open top;

means for vibrating said feeder bowl so that said fibers move along said sidewall thereof;

discharge means formed in said sidewall of said feeder bowl for permitting the withdrawal of fibers from said feeder bowl and into said interior of said fiber collector.

4. The apparatus of claim 3 in which said sidewall of said feeder bowl is formed with a spiral feed track extending radially inwardly from said sidewall, said discharge means for permitting the withdrawal of fibers from said feeder bowl comprising a screen mounted over an opening formed in said sidewall of said feeder bowl along a portion of said spiral feed track, said screen permitting the passage of fibers through said sidewall and into said interior of said fiber collector.

5. The apparatus of claim 4 in which said spiral feed track extends radially inwardly from and substantially horizontal to said upstanding sidewall of said feeder bowl, said screen being mounted to said feeder bowl with a first plate and a second plate, said first plate extending over a portion of one side of said screen and being connected to said feed track, and said second plate extending over a portion of the opposite side of said screen and being connected to said upstanding sidewall.

6. The apparatus of claim 3 in which said fiber collector comprises:

a tube mounted exteriorly of said feeder bowl beneath said discharge means formed in said sidewall thereof;

a pair of opposed, tapered fiber guides connected to the top of said tube on either side of an elongated slot formed in said tube, said fiber guides receiving fibers passing from said feeder bowl through said discharge means and directing said fibers through said elongated slot into the interior of said tube;

said tube having an open inlet end and an outlet end connected to said inlet end of said delivery hose, said pump creating a negative pressure within said interior of said tube to draw fibers from said feeder bowl into said interior of said tube and to entrain said fibers in a stream of air drawn through said open inlet end of said tube.

7. The apparatus of claim 6 in which said fiber collector includes means connected to said tube for varying the negative pressure applied by said pump within said interior of said fiber collector.

8. The apparatus of claim 7 in which said means for varying said negative pressure within said interior of said fiber collector comprises:

means for mounting one of said tapered fiber guides to said feeder bowl so that said tube is positioned beneath said discharge means, said fiber collector thereby having an interior defined on one side by said sidewall of said feeder bowl, on the top by said discharge means of said feeder bowl and on the bottom by said tube;

at least one slide plate mounted to said other tapered fiber guide of said tube, said slide plate defining a side of said interior of said fiber collector opposite said sidewall of said feeder bowl, said slide plate being movable between a lowered position spaced from said discharge means so that an opening is formed in said interior of said fiber collector on one side thereof, and a raised position adjacent said discharge means so that said interior of said fiber collector is substantially closed on all sides, the negative pressure applied by said pump within said interior of said fiber collector increasing as said slide plate moves from said lowered position to said raised position.

9. Apparatus for spraying fibers, comprising:

a fiber collector having an interior formed with an inlet and an outlet;

means for feeding fibers into said interior of said fiber collector;

a pump having a suction inlet and a discharge outlet;

a spray device connected to said discharge outlet of said pump;

a delivery hose having an inlet end connected to said outlet of said fiber collector and an outlet end connected to said suction inlet of said pump, said outlet end of said delivery hose being positioned vertically higher than said inlet end thereof, said pump creating a negative pressure within said interior of said fiber collector to entrain fibers therein within a stream of air drawn through said inlet of said fiber collector and to transmit said air-entrained fibers through said delivery hose from said fiber collector to said pump;

means for introducing a volume of air upstream from said suction inlet of said pump so that the velocity of said air-entrained fibers flowing through said delivery tube decreases at an area therealong upstream from said pump to create an accumulation of fibers within said delivery tube at said area, said pump being effective to withdraw a uniform quantity of fibers from said area into said suction inlet thereof and to eject said air-entrained fibers through said discharge outlet into said spray device for deposition onto a substrate.

10. The apparatus of claim 9 in which said means for introducing said volume of air upstream from said suction inlet of said pump is an air flow amplifier which is oriented to direct a stream of air in an upstream direction within said delivery hose.

11. Apparatus for feeding fibers, comprising:

a feed hopper having an inlet for receiving fibers in bulk and an outlet;

a trough connected to said outlet of said feed hopper, said trough having a discharge end;

means for vibrating said feed hopper and said trough to cause fibers to move through said outlet of said feed hopper onto said trough and then to said discharge end of said trough;

a feeder bowl located beneath said trough to receive fibers from said discharge end thereof, said feeder bowl having a bottom, a sidewall extending upwardly from said bottom and an open top, said sidewall being formed with a feed track extending radially inwardly therefrom toward the center of said feeder bowl;

means for vibrating said feeder bowl so that said fibers move along said sidewall thereof and over said feed track;

discharge means formed in said feed track of said sidewall of said feeder bowl for permitting the withdrawal of fibers from said feeder bowl;

a fiber collector located exteriorly of said feeder bowl beneath said discharge means in said feed track of said sidewall;

pump means connected to said fiber collector for creating a negative pressure within the interior thereof to draw fibers from said feeder bowl through said discharge means and into said fiber collector, and to entrain said fibers in a stream of air within said fiber collector for discharge therefrom.

12. The apparatus of claim 11 in which said discharge means comprises a screen mounted over an opening formed in said sidewall of said feeder bowl along a portion of said feed track, said screen permitting the passage of a selected quantity of fibers through said sidewall and into said interior of said fiber collector.

13. The apparatus of claim 12 in which said feed track extends radially inwardly from and substantially horizontal to said upstanding sidewall of said feeder bowl, said screen being mounted to said feeder bowl with a first plate and a second plate, said first plate extending over a portion of one side of said screen and being connected to said feed track, and said second plate extending over a portion of the opposite side of said screen and being connected to said upstanding sidewall.

14. The apparatus of claim 11 in which said fiber collector comprises:

a tube mounted exteriorly of said feeder bowl beneath said discharge means formed in said sidewall thereof;

a pair of opposed, tapered fiber guides connected to the top of said tube on either side of an elongated slot formed in said tube, said fiber guides receiving fibers passing from said feeder bowl through said discharge means and directing said fibers through said elongated slot into the interior of said tube.

15. The apparatus of claim 14 in which said fiber collector includes means for varying the negative pressure applied by said pump means within said tube.

16. The apparatus of claim 15 in which said means for varying said negative pressure within said interior of said fiber collector comprises:

means for mounting one of said tapered fiber guides to said feeder bowl so that said tube is positioned beneath said discharge means, said fiber collector thereby having an interior defined on one side by said sidewall of said feeder bowl, on the top by said discharge means of said feeder bowl and on the bottom by said tube;

at least one slide plate mounted to said other tapered fiber guide of said tube, said slide plate defining a side of said interior of said fiber collector opposite said sidewall of said feeder bowl, said slide plate being movable between a lowered position spaced from said discharge means so that an opening is formed in said interior of said fiber collector on one side thereof, and a raised position adjacent said discharge means so that said interior of said fiber collector is substantially closed on all sides, the negative pressure applied by said pump within said interior of said fiber collector increasing as said slide plate moves from said lowered position to said raised position 17. A system for spraying fibers, comprising:

a cabinet having a fiber delivery compartment and a fiber discharge compartment, said fiber delivery and fiber discharge compartments being separated by a common, inner sidewall;

a feed hopper located within said fiber delivery compartment, said feed hopper having an inlet for receiving fibers in bulk and an outlet;

a trough connected to said outlet of said feed hopper, said trough having a discharge end;

means for vibrating said feed hopper and said trough to cause fibers to move through said outlet of said feed hopper onto said trough and then to said discharge end of said trough;

a feeder bowl located beneath said trough to receive fibers from said discharge end thereof, said feeder bowl having a bottom, a sidewall extending upwardly from said bottom and an open top;

means for vibrating said feeder bowl so that said fibers flow along said sidewall thereof;

discharge means formed in said sidewall of said feeder bowl for permitting the withdrawal of fibers from said feeder bowl;

a fiber collector having an interior formed with an inlet and an outlet, said fiber collector being mounted exteriorly of said feeder bowl beneath said discharge means in said sidewall thereof for receiving fibers passing through said discharge means;

a pump located within said fiber discharge compartment of said cabinet, said pump having a suction inlet and a discharge outlet;

a spray device connected to said discharge outlet of said pump;

a delivery hose having an inlet end connected to said outlet of said fiber collector and an outlet end connected to said suction inlet of said pump, said pump creating a negative pressure within said interior of said fiber collector to entrain fibers therein within a stream of air drawn through said inlet of said fiber collector and to transmit said air-entrained fibers through said delivery hose from said fiber collector to said pump;

means for accumulating said air-entrained fibers at an area within said delivery hose upstream relative to said pump and said outlet end of said delivery hose, said pump being effective to withdraw said air-entrained fibers from said area within said delivery hose into said suction inlet thereof and to eject said air-entrained fibers through said discharge outlet into said spray gun;

a conveyor movable through said fiber discharge compartment beneath said spray device, said spray device being effective to discharge said fibers onto articles carried on said conveyor.

18. The apparatus of claim 17 in which said means for accumulating said air-entrained fibers within said delivery tube comprises:

means for supporting said delivery tube on said common inner sidewall of said cabinet so that said outlet end thereof is positioned vertically higher than said inlet end;

means for introducing a separate stream of air into said suction inlet of said pump.

19. The apparatus of claim 18 in which said means for introducing said separate stream of air into said pump is an air flow amplifier located upstream from said suction inlet of said pump and oriented to direct a stream of air in an upstream direction within said delivery hose.

20. The apparatus of claim 17 in which said sidewall of said feeder bowl is formed with a radially inwardly extending spiral feed track, said discharge means comprising a screen mounted over an opening formed in said sidewall along a portion of said spiral feed track, said screen permitting the passage of fibers through said sidewall and into said interior of said fiber collector.

21. The apparatus of claim 20 in which said spiral feed track extends radially inwardly from and substantially horizontal to said upstanding sidewall of said feeder bowl, said screen being mounted to said feeder bowl with a first plate and a second plate, said first plate extending over a portion of one side of said screen and being connected to said feed track, and said second plate extending over a portion of the opposite side of said screen and being connected to said upstanding sidewall.

22. The apparatus of claim 17 in which said fiber collector comprises:

a tube mounted exteriorly of said feeder bowl beneath said discharge means formed in said sidewall thereof;

a pair of opposed, tapered fiber guides connected to the top of said tube on either side of an elongated slot formed in said tube, said fiber guides receiving fibers passing from said feeder bowl through said discharge means and directing said fibers through said elongated slot into the interior of said tube;

said tube having an open inlet end and an outlet end connected to said inlet end of said delivery hose, said pump creating a negative pressure within said interior of said tube to draw fibers from said feeder bowl into said interior of said tube and to entrain said fibers in a stream of air drawn through said open inlet end of said tube.

23. The apparatus of claim 22 in which said fiber collector includes means connected to said tube for varying the negative pressure applied by said pump within said interior of said fiber collector.

24. The apparatus of claim 23 in which said means for varying said negative pressure within said interior of said fiber collector comprises:

means for mounting one of said tapered fiber guides to said feeder bowl so that said tube is positioned beneath said discharge means, said fiber collector thereby having an interior defined on one side by said sidewall of said feeder bowl, on the top by said discharge means of said feeder bowl and on the bottom by said tube;

at least one slide plate mounted to said other tapered fiber guide of said tube, said slide plate defining a side of said interior of said fiber collector opposite said sidewall of said feeder bowl, said slide plate being movable between a lowered position spaced from said discharge means so that an opening is formed in said interior of said fiber collector on one side thereof, and a raised position adjacent said discharge means so that said interior of said fiber collector is substantially closed on all sides, the negative pressure applied by said pump within said interior of said fiber collector increasing as said slide plate moves from said lowered position to said raised position.

25. Apparatus for spraying fibers, comprising:

a fiber collector having an interior formed with an inlet and an outlet;

means for feeding fibers into said interior of said fiber collector;

a pump having a suction inlet and a discharge outlet;

a delivery hose having an inlet end connected to said outlet of said fiber collector and an outlet end connected to said suction inlet of said pump, said pump creating a negative pressure within said interior of said fiber collector to entrain fibers therein within a stream of air drawn through said inlet of said fiber collector and to transmit said air-entrained fibers through said delivery hose from said fiber collector to said pump;

a spray gun having an inlet connected substantially directly to said discharge outlet of said pump, said pump transmitting said air-entrained fibers directly into said spray gun and said spray gun ejecting the fibers onto a substrate.

26. A method of spraying fibers, comprising:

pumping air-entrained fibers through a delivery hose having an inlet end communicating with a source of fibers and an outlet end;

creating an accumulation of fibers at an area within said delivery hose upstream from said outlet end thereof;

drawing the accumulated fibers from said area within said delivery hose and transmitting the fibers from said outlet end thereof into a spray device for discharge onto a substrate.

27. A method of spraying fibers, comprising:

pumping air-entrained fibers through a delivery hose having an inlet end communicating with a source of fibers and an outlet end;

reducing the velocity of the air-entrained fibers moving through said delivery hose so that the air-entrained fibers accumulate at an area within said delivery hose upstream from said outlet end thereof;

drawing the accumulated fibers from said area within said delivery hose and transmitting the fibers from said outlet end thereof into a spray device for discharge onto a substrate.

28. A method of spraying fibers, comprising:

pumping air-entrained fibers through a delivery hose having an inlet end communicating with a source of fibers and an outlet end connected to a pump, said outlet end of said delivery hose being positioned vertically higher than said inlet end thereof;

introducing a volume of air between said outlet end of said delivery hose and said pump to create an accumulation of fibers at an area within said delivery hose upstream from said pump;

drawing the accumulated fibers from said area within said delivery hose and transmitting the fibers into a spray device for discharge onto a substrate.

29. A method of spraying fibers, comprising:

positioning a delivery hose having an inlet end communicating with a source of fibers and an outlet end connected to a pump so that said outlet end is vertically higher than said inlet end;

pumping air-entrained fibers through said delivery hose from said inlet end upwardly toward said outlet end and said pump;

introducing a volume of air between said outlet end of said delivery hose and said pump to reduce the velocity of air-entrained fibers moving through said delivery hose and thus create an accumulation of fibers in an area within said delivery hose upstream from said pump;

drawing the accumulated fibers from said area within said delivery hose and transmitting the fibers into a spray device for discharge onto a substrate.

30. A method of spraying fibers, comprising:

discharging fibers through an apertured opening formed in the sidewall of a vibrating feeder bowl;

receiving the fibers discharged from said vibrating feeder bowl in the interior of a fiber collector;

entraining fibers collected within the interior of said fiber collector in a stream of air to form a stream of air-entrained fibers;

creating a negative pressure within a delivery hose having an inlet end connected to said fiber collector and an outlet end connected to a pump to transmit the air-entrained fibers from said fiber collector to said pump, said outlet end of said delivery hose being located vertically higher than the inlet end thereof;

introducing a volume of air between said delivery hose and said pump to create an accumulation of fibers within an area of said delivery hose;

drawing the accumulated fibers from said area within said delivery hose into the pump and ejecting the fibers from the pump into a spray gun for discharge onto a substrate.

31. A method of feeding fibers, comprising:

discharging fibers from a feed hopper into a vibrating feeder bowl;

passing the fibers over a screen which covers an opening formed in the sidewall of said vibrating feeder bowl;

creating a negative pressure within a fiber collector located beneath said opening in said sidewall of said feeder bowl to draw fibers from said feeder bowl, through said screen covering said opening and into said fiber collector;

entraining said fibers drawn into said fiber collector in a stream of air in preparation for discharge from said fiber collector.

32. The method of claim 31 in which said step of creating a negative pressure within a fiber collector comprises varying the position of a sliding plate in the sidewall of said fiber collector from an open position in which an opening is formed in said fiber collector to allow the passage of air therethrough and a closed position in which said opening in said sidewall of said fiber collector is substantially closed to block the flow of air therethrough, the negative pressure within said fiber collector increasing as said sliding plate moves from said open position to said closed position.

* * * * *